US005395513A

United States Patent [19]

Chin et al.

[11] Patent Number: 5,395,513

[45] Date of Patent: Mar. 7, 1995

[54] FLUID BED CATALYTIC UPGRADING OF REFORMATE

[75] Inventors: Arthur A. Chin, Cherry Hill, N.J.; Mohsen N. Harandi, Langhorne, Pa.; Karen M. Millane, Mantua, N.J.; Robert A. Ware, Wyndmoor; James S. Warwick, Doylestown, both of Pa.

[73] Assignee: Mobil Oil Corporation, Fairfax, Va.

[21] Appl. No.: 106,690

[22] Filed: Aug. 16, 1993

[51] Int. Cl.[6] ..... C10G 35/095

[52] U.S. Cl. ..... 208/135; 208/141; 585/447; 585/467

[58] Field of Search ..... 208/64, 135, 141; 585/447, 467

[56] References Cited

U.S. PATENT DOCUMENTS

| | | | |
|---|---|---|---|
| 3,729,409 | 4/1973 | Chen | 208/135 |
| 3,845,150 | 10/1974 | Yan et al. | 260/673.5 |
| 3,890,218 | 6/1975 | Morrison | 208/135 |
| 3,926,782 | 12/1975 | Plank et al. | 208/135 |
| 3,950,241 | 4/1976 | Bonacci et al. | 208/64 |
| 4,162,212 | 7/1979 | Miller | 208/64 |
| 4,181,599 | 1/1980 | Miller et al. | 208/135 |
| 4,443,326 | 4/1984 | Field | 208/64 |
| 4,827,069 | 5/1989 | Kushnerick et al. | 585/415 |
| 5,177,283 | 1/1993 | Ward | 585/446 |
| 5,198,102 | 3/1993 | Kaul et al. | 208/310 |

OTHER PUBLICATIONS

"Shape Selective Catalysis in Industrial Applications", Chen et al., (Marcel Dekker, 1989) pp. 165–173.

*Primary Examiner*—Helen M. S. Sneed
*Assistant Examiner*—Walter D. Griffin
*Attorney, Agent, or Firm*—Alexander J. McKillop; Malcolm D. Keen; L. Gene Wise

[57] ABSTRACT

A continuous process for upgrading reformate feedstock or the like to reduce benzene content and increase octane fuel rating. The improved process comprises maintaining a fluidized bed of regenerable acid solid medium pore zeolite catalyst particles in a turbulent regime reaction zone, preferably maintained with a superficial gas velocity of 0.1 to 1 meter/sec. with reformate feedstock being introduced at a bottom portion of the reaction zone at a weight hourly space velocity (WHSV) of 0.1 to 5, based on active catalyst solids; reaction zone total pressure being less than 2000 kPa. The preferred catalyst particles have an average particle size of 20 to 100 microns ($\mu$), with about 10 to 25% of the catalyst particles comprising fine particles having a particle size less than 30 microns; and the preferred zeolite catalyst comprises shape selective medium pore aluminosilicate zeolite having a constraint index of 1 to 12. The benzene is reacted by contacting reformate feedstock, such as $C_6$ distillation heart cut containing at least 70 wt % compounds having six carbon atoms, including benzene, n-hexane and isohexane, with said catalyst particles at reaction temperature of 370° to 540° C. and at benzene partial pressure of at least 200 kPa under reformate conversion conditions sufficient to convert at least 40% of feedstock benzene per pass, thereby producing a high octane fuel product containing less than 10 wt % $C_{10}$+ components.

6 Claims, No Drawings

FLUID BED CATALYTIC UPGRADING OF REFORMATE

BACKGROUND OF THE INVENTION

Production requirements for gasoline fuels have limited the amount of benzene permitted, creating a strong incentive for removing benzene from high octane fuel mixtures. Conventional catalytic reforming has been employed in production of gasoline by converting low octane paraffinic naphtha to high octane blending mixtures rich in benzene, toluene and xylenes (BTX). U.S. Pat. No. 3,729,409 (Chen) discloses a catalytic method for improving the yield-octane number of a reformate by contacting the reformate in the presence of hydrogen over a zeolite catalyst, such as medium pore ZSM-5. "Shape Selective Catalysis in Industrial Applications" by Chen et al (Marcel Dekker, 1989) describes a post-reforming process, "M-Forming", wherein ZSM-5 functions to crack paraffins and alkylate benzene present in the reformate. Conversion of alkenes and alkanes to produce aromatics-rich liquid hydrocarbon products was found by Yan et al. U.S. Pat. No. 3,845,150 to be effective using the ZSM-5 type zeolite catalysts in a fluid bed process. In U.S. Pat. No. 4,827,069, Kushnerick et al. describe fluid bed alkylation of benzene with lower olefins for upgrading reformate.

Prior art catalytic processes for benzene reduction in reformate typically do not provide a large benzene conversion in a single pass unit operation. This deficiency limits the amount of benzene that can be effected in continuous catalytic operations.

It has been discovered that hydrocarbon mixtures of benzene and paraffins, such as $C_6$–$C_8$ n-alkanes and isoalkanes, can be upgraded efficiently in a continuous fluidized catalyst process to achieve at least 45% benzene conversion in a single pass operation. It has now been found that contacting a catalytic reformate feed comprising benzene and $C_6$ to $C_8$ alkanes and other hydrocarbons with a zeolite catalyst that the benzene can be converted effectively to lower alkyl aromatic hydrocarbons while at the same time converting lower value alkanes to higher value $C_5$+ hydrocarbons, both of which products are suitable for use as gasoline blending stocks.

SUMMARY OF THE INVENTION

In accordance with the present invention it has been found that benzene-rich light reformate can be upgraded to liquid hydrocarbons rich in alkyl aromatics of higher octane value by catalytic conversion in a turbulent fluidized bed of solid acid zeolite catalyst under reaction conditions in a single pass operation. This technique is particularly useful for upgrading catalytic reformate containing $C_6$ to $C_8$ aromatics and $C_5$ to $C_9$ paraffins, especially the $C_6$ heartcut, which contains benzene, n-hexane, isohexane and cyclohexane. Accordingly, it is a primary object of the present invention to provide a novel technique for upgrading light reformate.

DETAILED DESCRIPTION OF THE INVENTION

The present invention is particularly useful for upgrading reformate which usually contains significant amounts of benzene, toluene, xylene and ethyl benzene.

Advantageously, the fluidized bed technique can employ a single pass benzene conversion of at least 40%

(preferably more than 50%) to provide high octane $C_5$+ gasoline range hydrocarbon product in good yield without significant recycle and without added hydrogen and/or diluent.

DESCRIPTION OF THE PROCESS

The present invention utilizes conventional petroleum refining steps including fractionation, catalytic reforming and fluidized catalytic conversion and a novel zeolite catalyst process to upgrade reformate process streams.

The catalytic reformate feedstock may contain $C_6$ to $C_8$ aromatic hydrocarbons and $C_5$ to $C_9$ paraffinic hydrocarbons. The $C_6$ to $C_8$ aromatic hydrocarbons include benzene, toluene, xylene and ethyl benzene (i.e. BTX). It is advantageous to employ feedstock which contains not more than 10 weight percent (wt %) $C_7$+ aromatic hydrocarbons, preferable less than 5 wt %. The xylene and ethyl benzene are herein considered together as $C_8$ aromatic hydrocarbon. Though the catalytic reformate is a preferred feedstock, hydrocarbon process streams containing essentially the same hydrocarbon components can also be used.

The process of the present invention using a ZSM-5 type zeolite catalyst is carried out at temperatures of 370° to 540° C. (700°–1000° F.), preferably 400° to 425° C. The total pressure at which the reaction is carried out and the concentration of benzene (partial pressure) are important parameters of the invention. The process can be carried out efficiently at pressures of about 300–2000 Kpa. The weight hourly space velocity (WHSV) of the reformate feed is also important to achieve high single pass benzene conversion.

The use of the turbulent regime fluidized bed catalyst process permits the conversion system to be operated at low pressure drop. An important advantage of the process is the close temperature control that is made possible by turbulent regime operation, wherein the uniformity of conversion temperature can be maintained within close tolerances, often less than 25° C. Except for a small zone adjacent the bottom gas inlet, the midpoint measurement is representative of the entire bed, due to the thorough mixing achieved.

In a typical process, $C_6$ to $C_8$ rich feedstock is converted in a catalytic reactor under elevated reaction temperature and moderate pressure conditions to produce a predominantly liquid product consisting essentially of $C_5$+ aliphatic hydrocarbons rich in gasoline-range olefins and $C_7$ to $C_{11}$ alkyl aromatic hydrocarbons. Advantageously, the reaction effluent stream contains less than 10 wt % $C_{10}$+ hydrocarbons.

Under optimized process conditions the turbulent bed has a superficial vapor velocity of about 0.1 to 1 meters per second (m/sec). At higher velocities entrainment of fine particles may become excessive or at transport velocity the entire bed may be transported out of the reaction zone. At lower velocities, the formation of large bubbles or gas voids can be detrimental to conversion. Even fine particles cannot be maintained effectively in a turbulent bed below about 0.1 m/sec.

A convenient measure of turbulent fluidization is the bed density. A typical turbulent bed has an operating density of about 100 to 500 kg/m$^3$, preferably about 300 to 500 kg/m$^3$, measured at the bottom of the reaction zone, becoming less dense toward the top of the reaction zone, due to pressure drop and particle size differentiation. This density is generally between the catalyst concentration employed in dense beds and the dispersed transport systems. Pressure differential between two vertically spaced points in the reactor column can be measured to obtain the average bed density at such portion of the reaction zone. For instance, in a fluidized bed system employing ZSM-5 particles having an apparent packed density of 750 kg/m$^3$ and real density of 2430 kg/m$^3$, an average fluidized bed density of about 300 to 500 kg/m$^3$ is satisfactory.

By virtue of the turbulence experienced in the turbulent regime, gas-solid contact in the catalytic reactor is improved, providing high conversion rate, enhanced selectivity and temperature uniformity. One main advantage of this technique is the inherent control of bubble size and characteristic bubble lifetime. Bubbles of the gaseous reaction mixture are small, random and short-lived, thus resulting in good contact between the gaseous reactants and the solid catalyst particles.

The weight hourly space velocity and uniform contact provides a close control of contact time between vapor or vapor and liquid and solid phases, typically about 3 to 25 seconds. Another advantage of operating in such a mode is the control of bubble size and life span, thus avoiding large scale gas by-passing in the reactor.

As the superficial gas velocity is increased in the dense bed, eventually slugging conditions occur and with a further increase in the superficial gas velocity the slug flow breaks down into a turbulent regime. The transition velocity at which this turbulent regime occurs appears to decrease with particle size. The turbulent regime extends from the transition velocity to the so-called transport velocity. The catalyst particles can be in a wide range of particle sizes up to about 250 microns, with an average particle size between about 20 and 100 microns, preferably in the range of 10–150 microns and with the average particle size between 40 and 80 microns. When these solid particles are placed in a fluidized bed where the superficial fluid velocity is 0.0–1 m/sec (preferably 0.3 to 0.8 m/sec), operation in the turbulent regime is obtained. The velocity specified here is for an operation at a total reactor pressure of about 1100 kPa. Those skilled in the art will appreciate that at higher pressures, a lower gas velocity may be employed to ensure operation in the turbulent fluidization regime.

The reactor can assume any technically feasible configuration, but several important criteria should be considered. The bed of catalyst in the reactor can be at least 5–20 meters in height. Fine particles may be included in the bed, especially due to attrition, and the fines may be entrained in the product gas stream. If the fraction of fines becomes large, a portion of the carryover can be removed from the system and replaced by larger particles. It is feasible to have a fine particle separator, such as a cyclone and/or filter means, disposed within or outside the reactor shell to recover catalyst carryover and return this fraction continuously to the bottom of the reaction zone. Optionally, fine particles carried from the reactor vessel entrained with effluent gas can be recovered by a high operating temperature sintered metal filter.

A typical reactor unit employs a temperature-controlled catalyst zone with indirect heat exchange and/or adjustable gas quench, whereby the reaction temperature can be carefully controlled within an operating range of about 370°–540° C., preferably at average reactor temperature of 400°–425° C.

The reaction temperature can be in part controlled by exchanging hot reactor effluent with feedstock and/or recycle streams. The reactor is operated at moderate pressure of about 300 to 2000 kPa (preferably about 500 to 1500 kPa). The weight hourly space velocity (WHSV), based on total hydrocarbons in the fresh feedstock and active catalyst solids, is about 0.1–5 WHSV. Typical product fractionation and catalyst regeneration systems that can be used are described in U.S. Pat. No. 4,456,779 (Avidan et al) and U.S. Pat. No. 5,043,517 (Haddad et al), incorporated herein by reference.

DESCRIPTION OF ZEOLITE CATALYSTS

Recent developments in zeolite technology have provided a group of medium pore siliceous materials having similar pore geometry. Most prominent among these intermediate pore size zeolites is ZSM-5 ("MFI"), which is usually synthesized with Bronsted acid active sites by incorporating a tetrahedrally coordinated metal, such as Al, Ga, Fe, or mixtures thereof including within the zeolitic framework. Medium pore aluminosilicate zeolites are favored for shape selective acid catalysis; however, the advantages of ZSM-5 structures may be utilized by employing highly siliceous materials or crystalline metallosilicate having one or more tetrahedral species having varying degrees of acidity. ZSM-5 crystalline structure is readily recognized by its X-ray diffraction pattern, which is described in U.S. Pat. No. 3,702,866 (Argauer, et al.), incorporated by reference.

The catalysts preferred for use herein include the medium pore (i.e., about 5–7 Å) shape-selective crystalline aluminosilicate zeolites having a silica-to-alumina ratio of at least 12, a constraint index of about 1 to 12 and significant Bronsted acid activity. Representative of the medium pore zeolites are ZSM-5 (U.S. Pat. No. 3,702,886), ZSM-11 (U.S. Pat. No. 3,709,979), ZSM-12 (U.S. Pat. No. 3,832,449), ZSM-22, ZSM-23 (U.S. Pat. No. 4,076,842), ZSM-35 (U.S. Pat. No. 4,016,245), ZSM-48 (U.S. Pat. No. 4,375,573) and MCM-22 (U.S. Pat. No. 4,954,325). Similar zeolites are disclosed in U.S. Pat. No. 4,966,680 (Avidan et al), U.S. Pat. No. 4,827,069 (Kushnerick et al) and U.S. Pat. No. 4,939,314 (Harandi et al). The disclosures of these patents are incorporated herein by reference.

While suitable zeolites having a coordinated metal oxide to silica molar ratio of 20:1 to 200:1 or higher may be used, it is advantageous to employ aluminosilicate ZSM-5 having a silica:alumina molar ratio of about 25:1 to 70:1, suitably modified to provide the desired acid activity. It is well known to treat acid zeolites with high temperature steaming (i.e., about 1000° F.) to adjust acid cracking (alpha value) to the desired level; however, it is feasible to introduce fresh makeup catalyst having an acid activity much higher than the average of the catalyst inventory. A typical zeolite catalyst component having Bronsted acid sites may consist essentially of crystalline aluminosilicate having the structure of ZSM-5 zeolite with 5 to 95 wt. % silica, clay and/or alumina binder.

These siliceous zeolites may be employed in their acid forms, ion-exchanged or impregnated with one or more suitable metals, such as Ga, Pd, Zn, Ni, Co and/or other metals of Periodic Groups III to VIII. The zeolite may include other components, generally one or more metals of group IB, IIB, IIIB, VA, VIA or VIIIA of the Periodic Table (IUPAC).

Certain of the medium pore, shape selective catalysts are sometimes known as pentasils. In addition to the preferred aluminosilicates, the gallosilicate, ferrosilicate and "silicalite" materials may be employed. ZSM-5 zeolites are particularly useful in the process because of their regenerability, long life and stability under the extreme conditions of operation. Usually the zeolite crystals have a crystal size from about 0.01 to over 2 microns or more, with 0.02–1 micron being preferred.

The catalyst has an apparent particle density of about 0.9 to 1.6 g/cm$^3$ and a size range of about 1 to 150 microns, and average catalyst particle size of about 20 to 100 microns containing about 10 to 25 weight percent of fine particles having a particle size less than 30 microns. In the preferred embodiments fluidized bed catalyst particles may consist essentially of 25–40 wt % H-ZSM-5 catalyst contained within a silica-alumina matrix and having an alpha value ($\alpha$) of less than about 10$\alpha$, based on total catalyst weight. In the following examples, the fluidized catalyst consists essentially of 25% H-ZSM-5 in an inert binder, having an average acid activity of 4$\alpha$ at the start of cycle.

The following examples demonstrate the superior conversion of benzene in a turbulent fluidized bed reactor and excellent properties of the reaction product. The feedstock is a commercial light petroleum naphtha reformate heartcut consisting predominantly of $C_6$ paraffins and benzene, with minor amounts of naphthenes, olefins, $C_5$ and $C_7$ hydrocarbons. This feed is essentially free of hydrogen and $C_4$- light hydrocarbon components. The total reaction pressure is maintained at 1130 kPa, with benzene concentration in the feedstock having a partial pressure of 380 kPa. The hourly feedrate is maintained at 2 parts by weight of reformate per part of active ZSM-5 catalyst (or WHSV=0.5/hr based on total catalyst solids) and the reaction temperature is 400°–440° C. The feedstock composition and reaction effluent are shown in Table 1 below.

TABLE 1

| | | Run #1 440° C./825° F. 1100 kPa/150 psig 8 hours | | Run #2 400° C./750° F. 1100 kPa/150 psig 16 hours | |
|---|---|---|---|---|---|
| Overall Composition, wt % | Feed | Product | Conversion | Product | Conversion |
| $H_2$ | 0.0 | 0.2 | | 0.1 | |
| $C_1$ | 0.0 | 1.2 | | 0.3 | |
| $C_2$ | 0.0 | 2.6 | | 0.8 | |
| $C_2^=$ | 0.0 | 0.3 | | 0.1 | |
| $C_3$ | 0.0 | 20.5 | | 11.6 | |
| $C_3^=$ | 0.0 | 0.6 | | 0.5 | |
| $iC_4$ | 0.0 | 6.2 | | 5.2 | |
| $nC_4$ | 0.0 | 5.6 | | 5.7 | |
| $C_4^=$ | 0.0 | 0.9 | | 0.8 | |
| $C_5^+$ | 100.0 | 61.9 | | 74.9 | |
| $C_5$ Olefin | 0.1 | 1.2 | | 1.0 | |
| $C_5$ N-Paraffin | 1.4 | 1.0 | | 2.2 | |
| $C_5$ Iso-Paraffin | 0.4 | 2.1 | | 2.6 | |
| $C_5$ Naphthene | 2.1 | 0.1 | | 0.4 | |
| $C_6$ Olefin | 1.4 | 0.2 | | 0.3 | |
| $C_6$ N-Paraffin | 19.7 | 0.3 | 99 | 2.7 | 86 |
| $C_6$ Methyl-Paraffins | 27.7 | 5.4 | 81 | 17.0 | 39 |
| $C_6$ Dimethyl-Paraffins | 6.4 | 2.6 | 59 | 5.7 | 11 |
| $C_6$ Naphthenes | 1.0 | 0.2 | 80 | 0.5 | 50 |
| Benzene | 31.1 | 14.4 | 54 | 17.1 | 45 |
| $C_7$ Olefin | 0.4 | 0.3 | | 0.3 | |
| $C_7$ N-Paraffin | 0.7 | <0.1 | 97 | <0.1 | 89 |
| $C_7$ Methyl-Paraffins | 4.6 | 0.5 | 89 | 2.1 | 54 |
| $C_7$ Dimethyl-Paraffins | 2.6 | 1.3 | 43 | 2.8 | |
| $C_7$ Naphthenes | 0.1 | 0.1 | | 0.1 | |
| Toluene | 0.4 | 7.8 | | 3.6 | |
| $C_8$ PON | 0.0 | 0.2 | | 0.3 | |
| $C_8$ Aromatics | 0.0 | 10.3 | | 7.2 | |
| $C_9$ PON | 0.0 | 1.1 | | 1.0 | |
| $C_9$ Aromatics | 0.0 | 4.4 | | 3.7 | |
| $C_{10}^+$ PON | 0.0 | 0.1 | | 0.2 | |
| $C_{10}^+$ Aromatics | 0.0 | 8.3 | | 4.0 | |
| $C_5^+$ Properties | | | | | |
| SG, @ 60° F. | 0.73 | 0.82 | | 0.77 | |
| RON | 74 | 103 | | 96 | |
| MON | 71 | 91 | | 86 | |
| RVP | 5.5 | 4.3 | | 5.5 | |

The product has less than 10 weight percent (wt %) $C_{10}^+$ material, greatly enhanced octane (RON and MON) with stable vapor pressure. In the conversion run described above, the reactor unit reaches steady state operation and is maintained without catalyst regeneration to demonstrate the effect of catalyst coking. Optimum operating conditions are reached at the end of 8 hours on stream at which time continuous steady state operation can be achieved by oxidatively regenerating the catalyst to maintain coke solids at less than 5 parts per 100 parts by weight (preferably about 3 pph), based on catalyst solids. When continued without catalyst regeneration up to 50 hours, the total coke deposited on the spent catalyst was 5.8%, which amounts to 0.2 wt % of the feedstock. It is preferred to operate the reactor under process conditions to maintain coke formation less than 0.5 wt %, based on hydrocarbon feedstock.

While the invention has been described by particular example, there is no intention to limit the inventive concept except as set forth in the following claims.

We claim:

1. A process for upgrading light reformate feedstock to reduce benzene content and increase octane fuel rating, comprising the steps of:

maintaining a fluidized bed of acid solid medium pore zeolite catalyst particles in a turbulent regime reaction zone;

contacting reformate feedstock containing benzene and alkane with said fluidized bed of acid solid medium pore zeolite catalyst particles at reaction temperature of 370° to 540° C. and at benzene partial pressure of at least 100 kPa under reformate conversion conditions sufficient to convert at least 40% of feedstock benzene.

2. The process of claim 1 wherein said light reformate feedstock comprises at least 70 wt % benzene and hexanes; said reaction temperature is in the range of 400° to 500° C., and total pressure in the reaction zone is less than 2000 kPa.

3. The process of claim 1 wherein said turbulent regime fluidized bed is maintained with a superficial gas velocity of 0.1 to 1 meter/sec. with reformate feedstock containing benzene at a partial pressure greater than 200 kPa being introduced at a bottom portion of the reaction zone at a weight hourly space velocity (WHSV) of 0.1 to 5, based on active catalyst solids; wherein said catalyst particles have an average particle size of 20 to 100 microns (μ), with about 10 to 25% of said catalyst particles comprising fine particles having a particle size less than 30 microns; and wherein said zeolite catalyst consists essentially of shape selective medium pore aluminosilicate zeolite having a constraint index of 1 to 12.

4. The process of claim 3 wherein said medium pore zeolite has the structure of ZSM-5, with an acid cracking value less than 10, based on total catalyst solids.

5. A continuous process for upgrading reformate feedstock to reduce benzene content and increase octane fuel rating, comprising the steps of:

maintaining a fluidized bed of regenerable acid solid medium pore zeolite catalyst particles in a turbulent regime reaction zone maintained with a superficial gas velocity of 0.1 to 1 meter/sec. with reformate feedstock being introduced at a bottom portion of the reaction zone at a weight hourly space velocity (WHSV) of 0.1 to 5, based on active catalyst solids; reaction zone total pressure being less than 2000 kPa,; said catalyst particles having an average particle size of 20 to 100 microns (μ), with about 10 to 25% of said catalyst particles comprising fine particles having an particle size less than 30 microns; and said zeolite catalyst consisting essentially of shape selective medium pore aluminosilicate zeolite having a constraint index of 1 to 12;

contacting reformate feedstock consisting essentially of a $C_6$ distillation heart cut containing at least 70 wt % compounds having six carbon atoms, including benzene, n-hexane and isohexane with said catalyst particles at reaction temperature of 370° to 540° C. and at benzene partial pressure of at least 100 kPa under reformate conversion conditions sufficient to convert at least 40% of feedstock benzene per pass;

thereby producing a high octane fuel product containing less than 10 wt % $C_{10}+$ components.

6. The process of claim 5 wherein said reformate feedstock comprises at least 70 wt % benzene and hexanes; said reaction temperature is in the range of 400° to 500° C., and total pressure in the reaction zone is less than 2000 kPa, with reformate feedstock containing benzene at a partial pressure greater than 200 kPa being introduced at a bottom portion of the reaction zone.

* * * * *